US006540835B2

(12) United States Patent
Kim et al.

(10) Patent No.: US 6,540,835 B2
(45) Date of Patent: Apr. 1, 2003

(54) SCRATCH RESISTANT COATING APPLICATION SYSTEM FOR VEHICLE

(75) Inventors: Byung-Jo Kim, Ulsan (KR); Seong-Ku Jang, Cheonan (KR)

(73) Assignee: Hyundai Motor Company, Seoul (KR)

( * ) Notice: Subject to any disclaimer, the term of this patent is extended or adjusted under 35 U.S.C. 154(b) by 105 days.

(21) Appl. No.: 09/751,305

(22) Filed: Dec. 29, 2000

(65) Prior Publication Data

US 2001/0017107 A1 Aug. 30, 2001

(30) Foreign Application Priority Data

Dec. 30, 1999 (KR) ..... 99-66818

(51) Int. Cl.[7] ..... B05C 11/00

(52) U.S. Cl. ..... 118/668; 118/692; 239/322; 134/57 R; 134/123

(58) Field of Search ..... 118/683, 679, 118/323, 692, 693, 713; 134/57 R, 123; 239/321, 322, 329

(56) References Cited

U.S. PATENT DOCUMENTS 4,444,547 A * 4/1984 Stolz ..... 417/46
4,616,782 A * 10/1986 Marietta et al. ..... 118/323
4,848,384 A * 7/1989 Christopher et al. ..... 134/57 R
5,020,472 A * 6/1991 Kiba et al. ..... 118/668
5,169,071 A * 12/1992 Boger et al. ..... 239/296

OTHER PUBLICATIONS

McGraw–Hill Dictionary of scientific and technical terms 3rd Edition, p. 1296.*

* cited by examiner

*Primary Examiner*—Richard Crispino
*Assistant Examiner*—Yewebdar T Tadesse
(74) *Attorney, Agent, or Firm*—Christie, Parker & Hale, LLP

(57) ABSTRACT

A scratch resistant coating application system for a vehicle includes: a pump having an output opening where a first end of a discharging line is connected, the pump storing aqueous emulsion; a feeder having an input opening where a second end of the discharging line is connected and an output opening where a first end of a feeding line is connected, the feeder releasing regulated aqueous emulsion into the feeding line; a sprayer connected to a second end of the feeding line for spraying the aqueous emulsion out to atmosphere; a robot having a robot arm on which the feeder and the sprayer are mounted, the robot arm carrying the sprayer; a visual system mounted on a ceiling of a work area for detecting a vehicle's position; and a central control unit electrically connected to the pump, the feeder, the robot, and the visual system for controlling the pump, the feeder, and the robot on the basis of data from the feeder and the visual system.

8 Claims, 3 Drawing Sheets

SCRATCH RESISTANT COATING APPLICATION SYSTEM FOR VEHICLE

CROSS-REFERENCE TO RELATED APPLICATION

This application claims priority of Korea patent Application No. 1999-66818, filed on Dec. 30, 1999.

BACKGROUND OF THE INVENTION (a) Field of the Invention

The present invention relates to a scratch resistant coating application system for a vehicle.

(b) Description of the Related Art

After the exterior components of a vehicle body, namely the hood, roof, deck lid, fenders, doors and quarter panels are assembled, vehicle bodies are coated during a series of steps constituting an overall coating process while the vehicle bodies are conveyed along a coating line.

The steps conducted in the coating line involve applying a corrosion protective electrodeposited layer, a primer, an intermediate basecoat, and finally applying a topcoat or overcoat.

Following the overall coating process, interior components are mounted to the vehicle body, and then a scratch resistant film or wax is applied to the vehicle body for protecting the coated surface from chips, bird excrement, environmental pollutants, and the like.

However, applying the scratch resistant film or waxing is performed by laborers even though the work is routine, so this reduces working efficiency.

Furthermore, there are some drawbacks in that the scratch resistant film is very expensive, and the wax pollutes the environment.

SUMMARY OF THE INVENTION

The present invention has been made in an effort to solve the above problems of the prior art.

It is an object of the present invention to provide a scratch resistant coating application system which allows the coating to be automatically applied to the surface of a vehicle body.

To achieve the above object, the scratch resistant coating application system of the present invention comprises a pump having an output opening where a first end of a discharge line is connected, the pump storing aqueous emulsion; a feeder having an input opening where a second end of the discharge line is connected and an output opening where a first end of a feeding line is connected, the feeder releasing regulated aqueous emulsion into the feeding line; a sprayer connected to a second end of the feeding line for spraying the aqueous emulsion out to atmosphere; a robot having a robot arm on which the feeder and the sprayer are mounted, the robot arm carrying the sprayer; a visual system mounted on a ceiling of a work area for detecting a vehicle's position; and a central control unit electrically connected to the pump, the feeder, the robot, and the visual system for controlling the pump, the feeder, and the robot on the basis of data from the feeder and the visual system.

BRIEF DESCRIPTION OF THE DRAWINGS

The accompanying drawings, which are incorporated in and constitute a part of the specification, illustrate an embodiment of the invention, and together with the description, serve to explain the principles of the invention.

DETAILED DESCRIPTION OF THE PREFERRED EMBODIMENTS

A preferred embodiment of the present invention will be described hereinafter with reference to the accompanying drawings.

Figure 1:
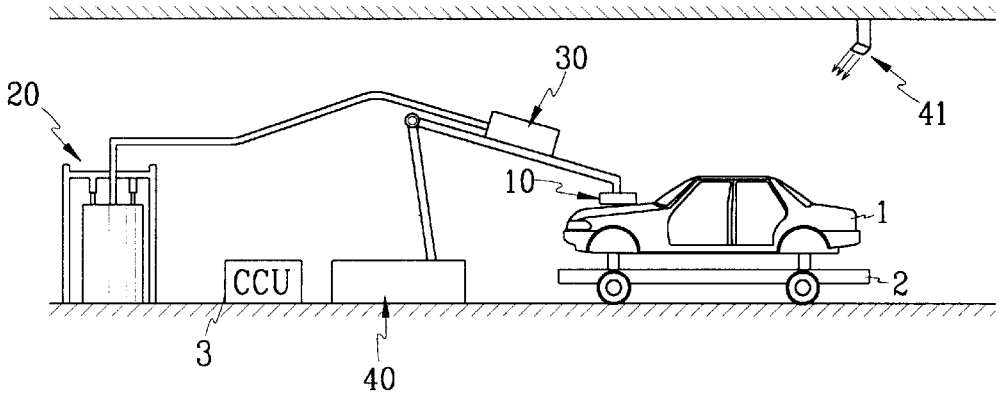
FIG. 1 is a schematic view of a scratch resistant coating application system of the preferred embodiment of the present invention.
Figure 2:
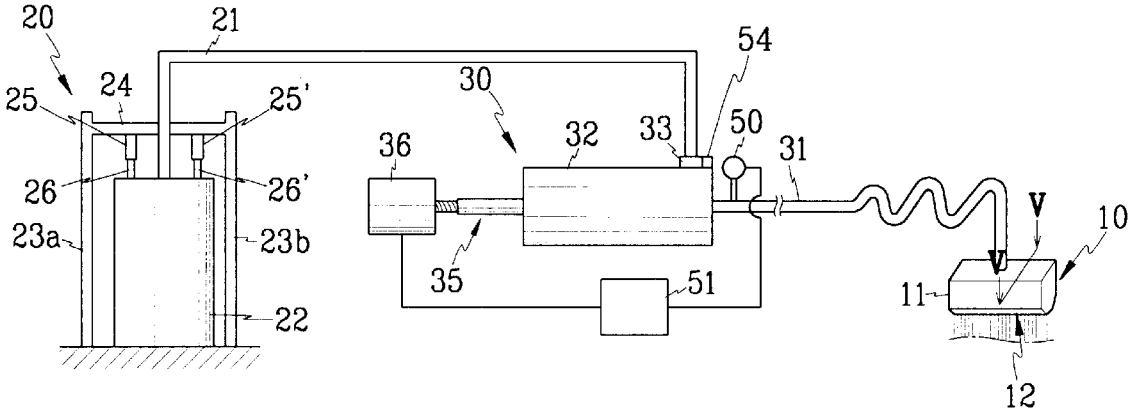
FIG. 2 is a drawing showing the main components comprising the scratch resistant coating application system of FIG. 1.

FIG. 1 is a schematic view showing a scratch resistant coating application system of the preferred embodiment of the present invention, and is FIG. 2 is a drawing showing major components of the scratch resistant coating application system of FIG. 1.

As shown in FIGS. 1 and 2, the scratch resistant coating application system comprises an emulsion pump 20 for supplying aqueous emulsion, an emulsion feeder 30 connected to the emulsion pump 20 through a discharging line 21, a sprayer 10 connected to the emulsion feeder 30 through a feeding line 31, and a central control unit 3 which is electrically connected to the emulsion pump 20 and the emulsion feeder 30.

Figure 3:
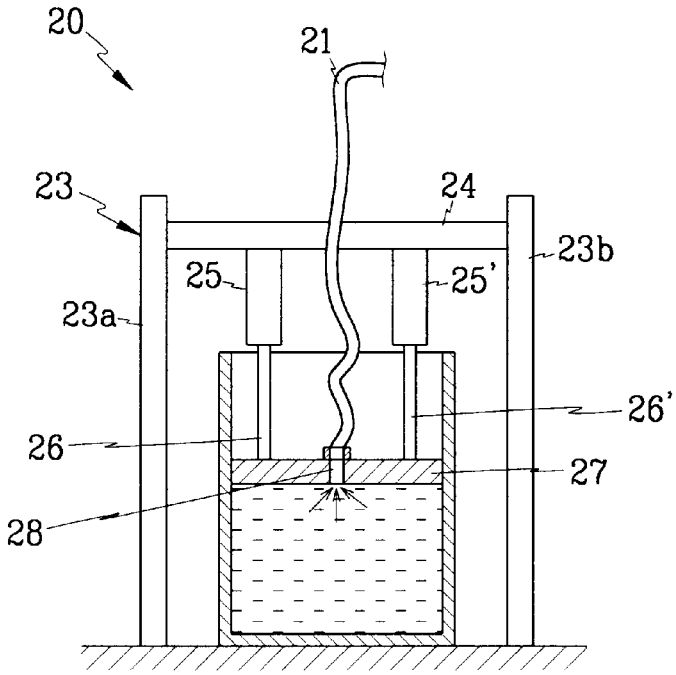
FIG. 3 is a front cross sectional view of an emulsion pump of the scratch resistant coating application system of FIG. 2.

FIG. 3 is a cross sectional view showing the emulsion pump of the scratch resistant coating application system according to the preferred embodiment of the present invention.

As shown in FIG. 3, the emulsion pump 20 comprises a closed cylindrical reservoir 22 for storing the aqueous emulsion therein, a plunger 27 tightly inserted into the reservoir 22, and a pair of actuators 25 and 25' having piston rods 26 and 26' each of which has one end connected to an upper surface of the plunger 27 through corresponding holes (not shown) formed on an upper wall of the reservoir 22. The two actuators 25 and 25' are supported by a support 23 comprising two columns 23*a* and 23*b* and a horizontal bar 24 connecting the two columns 23 and 23' to each other at their upper end portion such that the actuators 25 and 25' are mounted on the horizontal bar 24 in a downward direction. Also the actuators 25 and 25' are electrically connected to the central control unit 3 such that the CCU 3 controls the actuators 25 and 25'. The plunger 27 is provided with an emulsion release hole 28 at its center such that a feeding line 21 is connected thereto.

Figure 4:
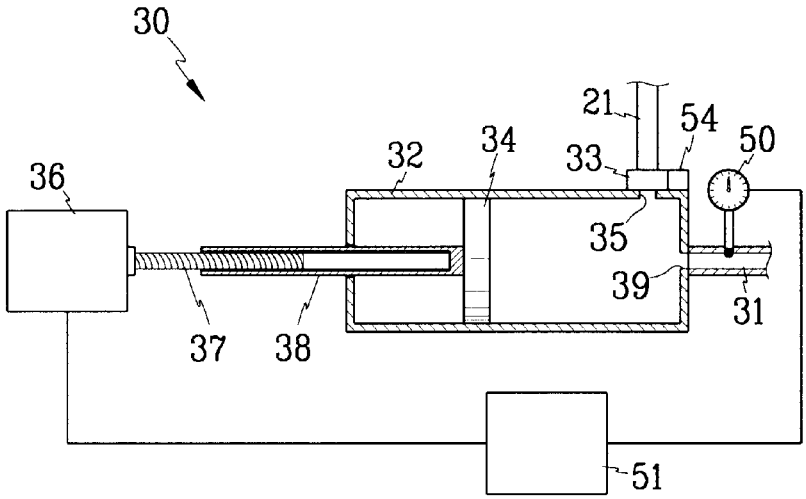
FIG. 4 is a front cross sectional view of an emulsion feeder of the scratch resistant coating application system of FIG. 2.

FIG. 4 is a front cross-sectional view showing the emulsion feeder of the scratch resistant coating application system of the present invention.

As shown in FIG. 4, the emulsion feeder 30 comprises: a feeder cylinder 32; a feeder plunger 34 tightly inserted into the feeder cylinder 32; a long cylindrical piston rod 38 of which one end is fixed to the feeder plunger 34 and the other end is open, the inner surface thereof being threaded; and a motor 36 driving an externally threaded rotational shaft 37 such that the rotational shaft 37 is screwed into and out of the piston rod 38 which allows the feeder plunger 34 to reciprocate in the feeder cylinder 32 according to the rotational direction of the motor 36. The feeder cylinder 32 is provided with an input opening 35 formed on the circumferential wall and an output opening 39 formed on a longitudinal end wall such that a check valve 33 is mounted at the input opening 35 and a first end of a feeding line 31 is connected to the output opening 39. Furthermore, an emulsion volume sensor 54 is provided together with the check valve 33 so as to detect the aqueous emulsion volume in the feeder cylinder 32 and send an electrical signal to the central control unit 3. The motor 36 is electrically connected to a controller 51, which is also electrically connected to a manometer 50 installed on the feeding line 31. The manometer 50 detects an emulsion feeding pressure and generates an electrical signal according to the pressure level and then sends the electrical signal to the controller 51 such that the controller 51 controls the rotational speed of the motor 36 on the basis of the electric signal from the manometer 50.

Figure 5:
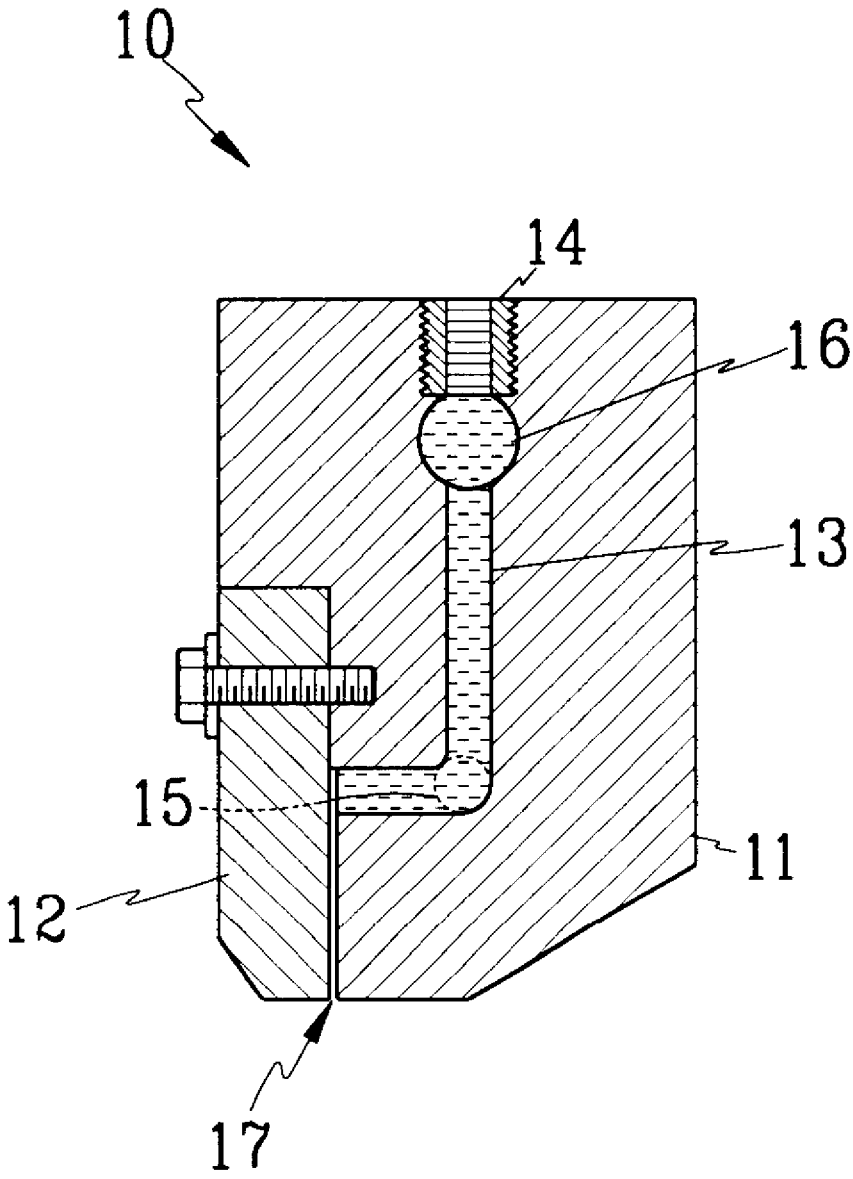
FIG. 5 is a cross sectional view cut along the line V—V of a sprayer of FIG. 2.

FIG. 5 is a cross-sectional view showing a sprayer 10 cut along the line D—D of FIG. 2.

As shown in FIG. 5, the sprayer 10 comprises a nozzle block 11 which is provided with an L shaped emulsion guide line 13 therein and a dead block 12 connected to the nozzle block 11 by means of a bolt so as to confront an outlet of the emulsion guide line 13 such that a long crevice is formed between the nozzle block 11 and the dead block 12. The nozzle block 11 is also provided with an inlet 14, threaded around an interior wall thereof for connecting to a second end of the feeding line 31. The L shaped emulsion guide line 13 is provided with a sphere space 16 at its upstream end for temporary buffering of the aqueous emulsion, and a bending portion 15 for providing an impact bend in order to enhance emulsion dispersion.

The central control unit (CCU) 3 is electrically connected to the actuators 25 and 25' of the emulsion pump 20, as well as to the emulsion volume sensor 54 of the emulsion feeder 30, such that the CCU generates a control signal on the basis of data detected by the emulsion volume sensor 54 of the emulsion feeder 30 and sends a control signal to the actuators 25 and 25'.

The scratch resistant coating application system further comprises a robot 40 having an arm 43 formed with two arm segments 43*a* and 43*b* linked to each other and a visual system 41 mounted on a ceiling of a work area. Also, the robot 40 and the visual system 41 are electrically connected to the CCU 3 such that if the visual system 41 detects a vehicle's position and sends a corresponding position signal to the CCU 3, and the CCU 3 generates a robot setting signal on the basis of the position signal and sends it to the robot 40.

The robot 40 acts as a sprayer carrier in such a way that the emulsion feeder 30 is mounted on the last arm segment 43*b* and the sprayer 10 is pivotally mounted at a free end of the robot arm 43.

The robot 40 can be a ceiling mounted or a floor mounted type having a predetermined radial working range, as commonly used in the field.

The visual system 41 comprises a camera that allows the visual system 41 to detect a vehicle's position and compares the present vehicle position to a preset vehicle position.

The operation of the scratch resistant coating application system according to the preferred embodiment of the present invention will be described hereinafter.

If a vehicle having the painting and coating processes completed is positioned in a work place, the vision system 42 detects the vehicle's position and sends a position signal to the CCU 3. The CCU 3 generates a robot setting signal on the basis of the position signal from the vision system 41 and sends it to the robot 40 such that the robot 40 commences on an action path with its arm 43 so as to carry the sprayer 10 according to the set action path. At the same time, the CCU 3 also sends a control signal to the actuators 25 and 25' such that the actuators 25 and 25' operate in order to push down the plunger 27. Accordingly, the aqueous emulsion in the emulsion pump reservoir 22 is exuded through the emulsion release hole 28 formed at the center of the plunger 27 and fed to the feeder cylinder 32 of the emulsion feeder 30 through the feeding line 21. Until this time, the feeder plunger 34 of the emulsion feeder 30 is completely retracted to the motor side. The check valve 33 mounted at the input opening 35 of the feeder cylinder 32 prevents the aqueous emulsion from flowing back.

If the feeder cylinder 32 is full, the emulsion volume sensor 54 detects that fact and sends an electrical signal to the CCU 3 such that the CCU 3 sends corresponding signals to the actuators 25 and 25' and the controller 51 of the emulsion feeder 30. Once the actuators 25 and 25' and the controller 51 receive the electrical signal, the actuators 25 and 25' stop their operation and the controller 51 sends a corresponding electrical signal to the motor 36 such that the motor 36 operates to move the feeder plunger 34 away from the motor. Accordingly, the aqueous emulsion is forced out through the feeding line 31 connected to the output hole 39 of the feeder cylinder 32 and supplied to the sprayer 10. The revolutions per minute (RPM) of the motor 36 are controlled by the controller 51 on the basis of the release pressure level detected by the manometer installed on the feeding line 31 such that the release pressure supplied to the sprayer 10 can be regulated.

Once the aqueous emulsion is supplied to the sprayer 10 through the output opening 39 connected to the feeding line 31, the aqueous emulsion flows through the emulsion guide line 13 formed in the nozzle block 11. During the aqueous emulsion flow through the guide line 13, a sphere space 16 formed at the upper end of the guide line 13 and the streamlined bending portion 15 enhance the emulsion dispersion so as to prevent abrupt spray. The aqueous emulsion guided by the guide line 13 meets with the dead block 12 connected to the nozzle block 11 such that the emulsion is sprayed through the long crevice formed between the nozzle block 11 and the dead block 12.

In order for this process to cover the whole vehicle, the robot arm 43 carries the sprayer 10 along the set action path.

As described above, since the scratch resistant coating application system of the present invention replaces the manual scratch resistant coating application labor with an automatic application system, it is possible to enhance the economic performance as well as working efficiency of the vehicle finishing process.

What is claimed is:

1. A scratch resistant coating application system for a vehicle comprising:

a pressurized reservoir having an output opening where a first end of a discharging line is connected, the pressurized reservoir storing aqueous emulsion;

a feeder having an input opening where a second end of the discharging line is connected and an output opening where a first end of a feeding line is connected, the feeder releasing regulated aqueous emulsion into the feeding line, wherein the feeder comprises, a feeder cylinder connected to the pressurized reservoir via the discharging line and to a sprayer via the second end of the feeding line, wherein the feeder cylinder is connected to the sprayer for feeding the aqueous emulsion from the pressurized reservoir to the sprayer and wherein the sprayer is for spraying the aqueous emulsion out to atmosphere, a feeder plunger tightly inserted into the feeder cylinder, a long cylindrical piston rod of which one end is connected to the feeder plunger, a motor having a rotational shaft which is connected to the piston rod so as to convert a rotational force of the motor into a reciprocating movement of the piston rod and the feeder plunger, a manometer mounted on the feeding line for detecting feeding pressure, and a controller electrically connected to the motor and the manometer for controlling the rotational force of the motor on the basis of a feeding pressure level detected by the manometer;

a robot having a robot arm on which the feeder and the sprayer are mounted, the robot arm carrying the sprayer;

a visual system mounted on a ceiling of a work area for detecting a vehicle's position; and a central control unit electrically connected to the pressurized reservoir, the feeder, the robot, and the visual system for controlling the pressurized reservoir, the feeder, and the robot on the basis of data from the feeder and the visual system.

2. A scratch resistant coating application system of claim 1 wherein the feeder cylinder further comprises a check valve mounted to the input opening for preventing the aqueous emulsion from flowing back.

3. A scratch resistant coating application system of claim 1 wherein the feeder cylinder further comprises a sensor for detecting if the feeder cylinder is full and sends a corresponding electrical signal to the central control unit.

4. A scratch resistant coating application system of claim 1 wherein the long piston rod is provided with a threaded inner wall for allowing the threaded rotational shaft of the motor to be received.

5. A scratch resistant coating application system for a vehicle comprising:

a pressurized reservoir having an output opening where a first end of a discharging line is connected, wherein the pressurized reservoir comprises, a reservoir for storing an aqueous emulsion, a plunger tightly inserted into the reservoir, a pair of actuators, each having a piston rod connected to an upper surface of the plunger, and a support formed outside of the reservoir for supporting the actuators;

a feeder having an input opening where a second end of the discharging line is connected and an output opening where a first end of a feeding line is connected, the feeder releasing regulated aqueous emulsion into the feeding line;

a sprayer connected to a second end of the feeding line for spraying the aqueous emulsion out to atmosphere;

a robot having a robot arm on which the feeder and the sprayer are mounted, the robot arm carrying the sprayer;

a visual system mounted on a ceiling of a work area for detecting a vehicle's position; and a central control unit electrically connected to the pressurized reservoir, the feeder, the robot, and the visual system for controlling the pressurized reservoir, the feeder, and the robot on the basis of data from the feeder and the visual system.

6. A scratch resistant coating application system of claim 5 wherein the central control unit compares a present vehicle position detected by the visual system with a preset vehicle position and sets an action path of the robot on the basis of a position error.

7. A scratch resistant coating application system for a vehicle comprising:

a pressurized reservoir having an output opening where a first end of a discharging line is connected, the pressurized reservoir storing aqueous emulsion;

a feeder having an input opening where a second end of the discharging line is connected and an output opening where a first end of a feeding line is connected, the feeder releasing regulated aqueous emulsion into the feeding line;

a sprayer connected to a second end of the feeding line for spraying the aqueous emulsion out to atmosphere, wherein the sprayer comprises, a nozzle block having an internal L shaped emulsion guide line for guiding the aqueous emulsion, wherein the L-shaped emulsion guide line has a sphere space at an upstream end portion for temporary buffering the aqueous emulsion and a bending portion for providing an impact bend in order to enhance emulsion dispersion, an inlet formed at an upper end of the emulsion guide line for receiving the second end of the feeding line, and a dead block connected to the nozzle block by means of a bolt so as to confront an outlet of the emulsion guide line;

a robot having a robot arm on which the feeder and the sprayer are mounted, the robot arm carrying the sprayer;

a visual system mounted on a ceiling of a work area for detecting a vehicle's position; and a central control unit electrically connected to the pressurized reservoir, the feeder, the robot, and the visual system for controlling the pressurized reservoir, the feeder, and the robot on the basis of data from the feeder and the visual system.

8. A scratch resistant coating application system for a vehicle comprising:

a pressurized reservoir having an output opening where a first end of a discharging line is connected, the pressurized reservoir storing aqueous emulsion;

a feeder having an input opening where a second end of the discharging line is connected and an output opening where a first end of a feeding line is connected, the feeder releasing regulated aqueous emulsion into the feeding line;

a sprayer connected to a second end of the feeding line for spraying the aqueous emulsion out to atmosphere, wherein the sprayer comprises, a nozzle block having an internal L shaped emulsion guide line for guiding the aqueous emulsion, an inlet formed at an upper end of the emulsion guide line for receiving the second end of the feeding line, and a dead block connected to the nozzle block by means of a bolt so as to confront an outlet of the emulsion guide line, wherein the nozzle block and the dead block form a long crevice therebetween such that the aqueous emulsion is sprayed through the crevice;

a robot having a robot arm on which the feeder and the sprayer are mounted, the robot arm carrying the sprayer;

a visual system mounted on a ceiling of a work area for detecting a vehicle's position; and a central control unit electrically connected to the pressurized reservoir, the feeder, the robot, and the visual system for controlling the pressurized reservoir, the feeder, and the robot on the basis of data from the feeder and the visual system.

* * * * *